US007533596B2

(12) United States Patent
Rathert

(10) Patent No.: US 7,533,596 B2
(45) Date of Patent: May 19, 2009

(54) THREE-SIDE TRIMMER, ESPECIALLY FOR SHORT RUNS

(75) Inventor: Horst Rathert, Minden (DE)

(73) Assignee: Mueller Martini Holdings AG, Hergiswill (CH)

( * ) Notice: Subject to any disclaimer, the term of this patent is extended or adjusted under 35 U.S.C. 154(b) by 385 days.

(21) Appl. No.: 10/051,577

(22) Filed: Jan. 16, 2002

(65) Prior Publication Data

US 2002/0092394 A1 Jul. 18, 2002

(30) Foreign Application Priority Data

Jan. 17, 2001 (DE) ..... 101 01 843

(51) Int. Cl.
*B26D 1/06* (2006.01)

(52) U.S. Cl. ..... 83/404.1; 83/934

(58) Field of Classification Search ..... 83/465, 83/458, 213, 404.1, 433, 934; 269/217, 275; 412/10, 22, 23; 100/211
See application file for complete search history.

(56) References Cited

U.S. PATENT DOCUMENTS

| | | | | | |
|---|---|---|---|---|---|
| 1,404,239 | A * | 1/1922 | Seybold | 269/216 |
| 1,612,956 | A * | 1/1927 | Valliquette | 83/465 |
| 3,064,512 | A * | 11/1962 | Zurlo | 83/174 |
| 3,122,041 | A * | 2/1964 | Kile | 83/155 |
| 3,722,336 | A | 3/1973 | Sarring | |
| 3,733,947 | A * | 5/1973 | Bryson et al. | 83/280 |
| 4,615,249 | A * | 10/1986 | Geiser | 83/221 |
| 4,711,439 | A * | 12/1987 | Campbell | 269/277 |
| 4,860,620 | A * | 8/1989 | Pizzorno | 83/156 |
| 5,279,196 | A * | 1/1994 | Mohr | 83/91 |
| 2002/0148339 | A1 * | 10/2002 | Zechini | 83/646 |
| 2004/0187660 | A1 * | 9/2004 | Kurtz | 83/13 |

FOREIGN PATENT DOCUMENTS

| | | |
|---|---|---|
| DE | 24 30 043 | 1/1975 |
| FR | 1 228 264 | 8/1960 |
| GB | 2 113 597 | 8/1983 |

* cited by examiner

*Primary Examiner*—Kenneth E. Peterson
(74) *Attorney, Agent, or Firm*—Venable LLP; Robert Kinberg; Justine A. Gozzi

(57) ABSTRACT

The three-side trimmer comprises three compact cutting units of a nearly identical design, which have a flow of forces that is closed in itself and separate drives. Full-area cutting tables and pressing plates and telescopic cutting tables and pressing plates in the head-and-foot station ensure optimal quality of cut while avoiding the use of replaceable parts for format change. Due to elastic design and a slightly oblique positioning of the pressing plates, air inclusions are prevented from occurring during the pressing. A most lightweight design possible with weak dynamic forces to achieve good quality of cut are provided while avoiding the use of replaceable parts for format change.

10 Claims, 3 Drawing Sheets

THREE-SIDE TRIMMER, ESPECIALLY FOR SHORT RUNS

FIELD OF THE INVENTION

The invention relates to three-side trimming, which is an essential process step in producing blocks for hardback books and in producing brochures.

BACKGROUND OF THE INVENTION

The three-side trimming is usually carried out in a station by the block pressed between a cutting table and a pressing plate being trimmed first at the head and the foot and then on the front. The sequence may also be reversed. The knives cut by a pinching cut against a plastic strip. The knife penetrates minimally the cutting strip during the cutting. To reduce the cutting forces at the beginning of the cutting and the cutting forces in general, the movement of the knives generates an oblique swing cut, and the movement component on the side along the knife edge is approximately equal to the normal cutting movement. At the beginning of the cutting of the block, the knife edge is at first not parallel to the cutting table, as a result of which the cut begins at a comer of the block and the cutting force increases from a low value to the maximum.

Three-side trimmers, also called trimmers, are also used in which the head and foot cut and the front cut are performed in separate stations. This type is used mainly in the case of large numbers of cutting cycles but small product thickness. The division into two stations makes possible the high cut counts.

The cutting is usually performed according to the shears principle by a knife against a counterknife. The blocks are held only by pressing strips directly next to the cutting plane for fixation during cutting.

The three-side trimmers of the type mentioned first, which cut in one station, make possible cutting of high quality in case of a solid, heavy design of the components. However, the drawback is, besides the heavy design of the components, that the pressing plate and the cutting table must be accurately coordinated format parts. The cutting table is a replaceable part with very small format jumps. The pressing plate must be accurately adapted to the finished, cut format for each product. Moreover, roundings and bevels also frequently have to be arranged in the production of brochures to prevent creases in the back and of print marks on the pressing plate from being formed. This is especially uneconomical, particularly for short runs, where the set-up time plays an especially great role.

The usual, commercially available two-station three-side trimmers are not suitable for the production of products of high quality.

Aside from the limitation of the cutting thickness, the pressing strips produce marks, especially on the back in brochures. Because of the absence of full-area pressing, there are deviations in cut. These trimmers advantageously have no format parts.

SUMMARY OF THE INVENTION

The present invention combines the advantages of the two systems and eliminates drawbacks by special features.

The three-sided trimming is carried out according to the present invention in two stations in order to eliminate the problem of replaceable parts for short runs. The head-and-foot cut and the front cut are performed in units of nearly identical design, and the cutting units for the head and foot in the head-and-foot station are adjustable in relation to one another according to the height of the format.

The knives cut by the usual oblique swing cut against cutting strips, which are replaceably fastened on stable table strips. As a result, great product thicknesses can be cut with a high quality of cut.

The pressing is performed by pressing strips directly next to the cut against the table strips.

To avoid deviations in cut, both the pressing strips of the head and foot and the table strips of the head and foot are connected to one another by telescoping adapters, so that the block is held down over the full area during cutting.

Due to a slightly oblique position and elasticity, the upper adapters ensure that the air is pressed out of the block from the back during pressing.

A full-area cutting table is present in the front cutting station, and the pressing strip is expanded by a holding-down clamp, which also presses the air away from the back due to an oblique position and an elastic surface.

All quality requirements are thus satisfied without the use of replaceable parts. Short set-up times are associated with high quality of cutting.

The cutting units are designed as elements that are closed in themselves. All pressing and cutting forces remain within the compact units.

The knives are guided with precision over a large surface. Deformations due to the cutting forces are prevented from occurring and optimal quality of cut is in turn achieved as a result. In addition, knife breakage is prevented from occurring.

The support frame for the cutting units can have a relatively lightweight design, which leads to a considerable weight reduction compared with a commercially available three-side trimmer.

To optimize handling during the knife change, the front cutting unit can be displaced in order to have good access to the front knife.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
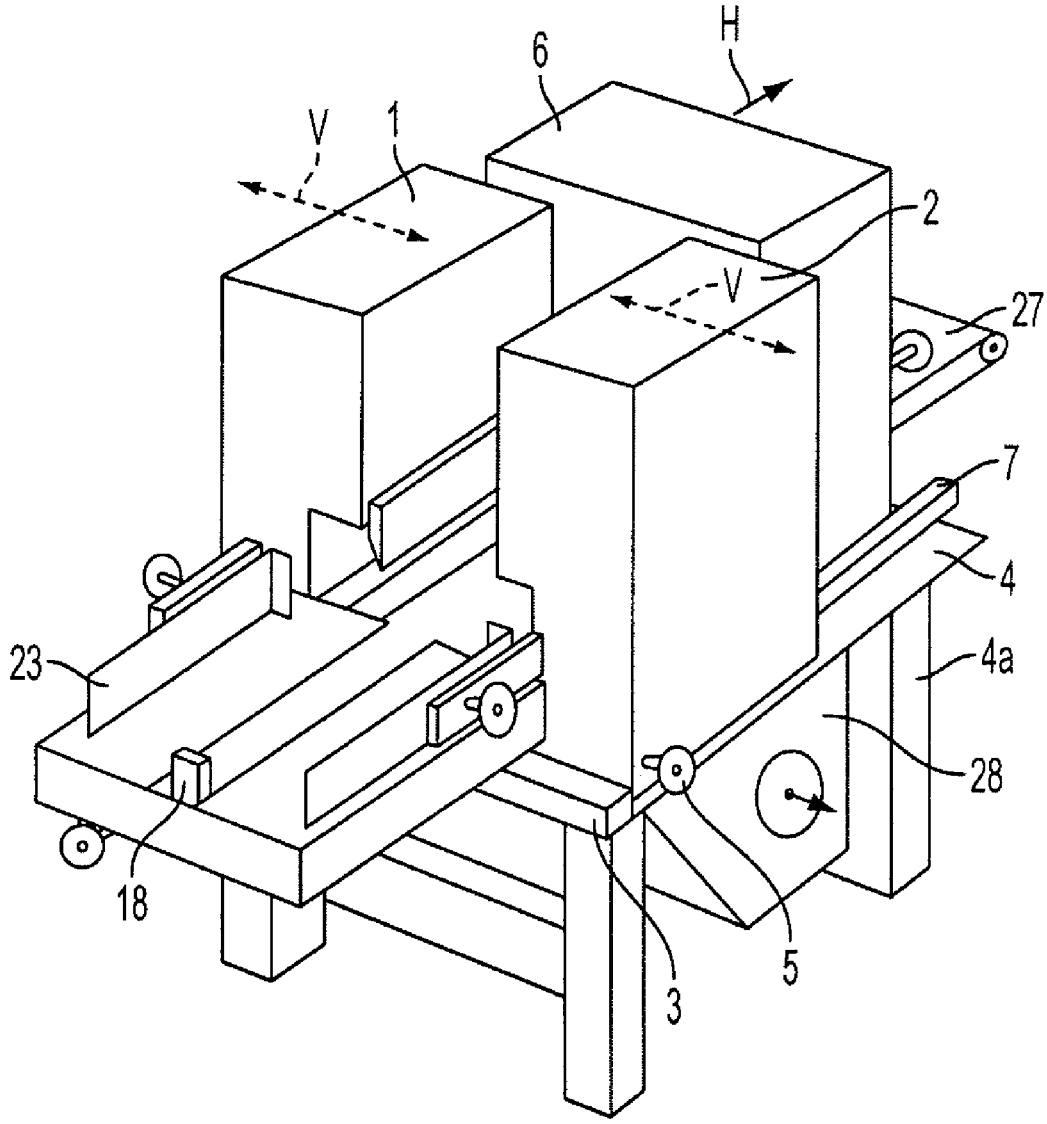
FIG. 1 is an overall perspective view of the three-side trimmer.
Figure 2:
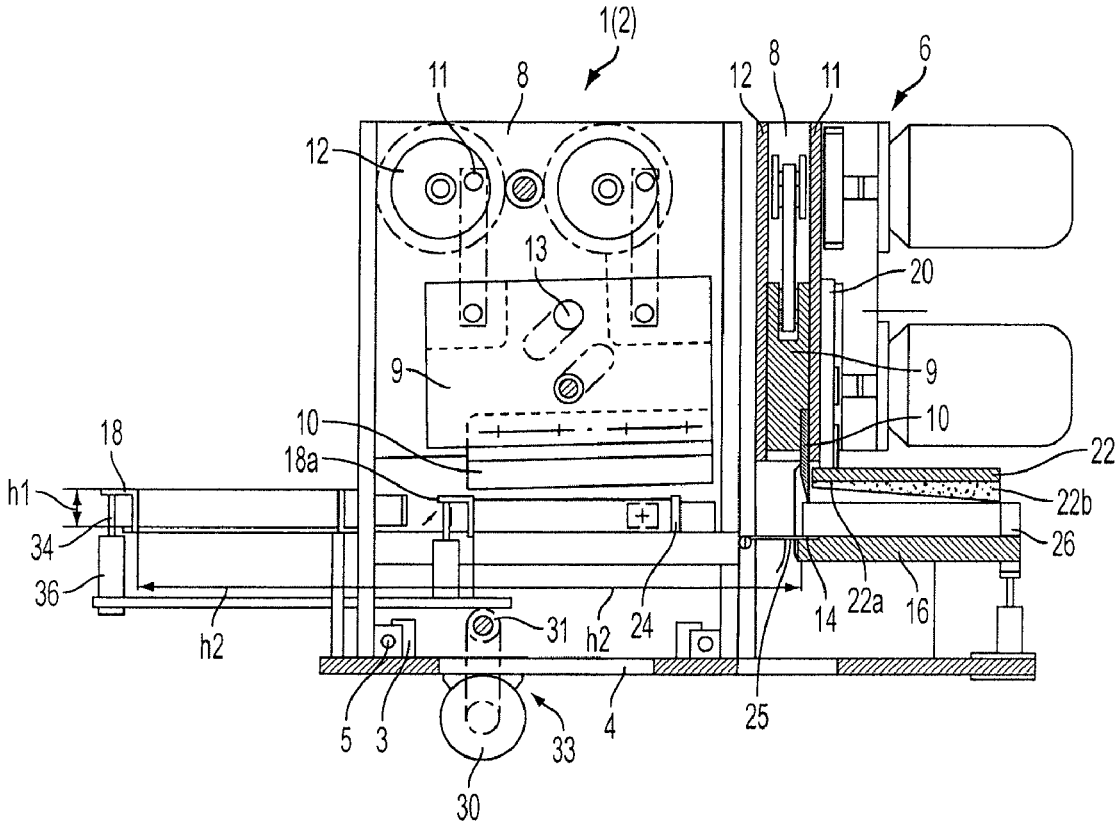
FIG. 2 is a longitudinal sectional view.

Referring to the drawings in particular, the cutting units for head 1 and foot 2 can be adjusted to format by the stroke v in the guides 3 on the support frame 4 with the feet 4*a*. An adjusting spindle 5 is used for this purpose. The cutting unit for front 6 can be displaced by the stroke h in the rails 7 on the support frame 4 to provide access to the front knife during the knife change. The cutting units 1, 2 and 6 are of identical design. The knife holders 9 with the knives 10 are guided in a unit frame 8. The movement takes place by means of the coupling rods 11 and the cranks 12. The obliquely extending swing cutting movement is generated by the guide roller 13, which is guided in an oblique groove in the knife holder 9. The knives cut against the cutting strips 14.

The cutting strips 14 are held in the head and foot stations 1, 2 by the strips 15, which are fastened directly to the frame

8. The cutting strips 14 are arranged in the front station at a full-format cutting table 16, which is likewise fastened directly to the frame 8.

Figure 3:
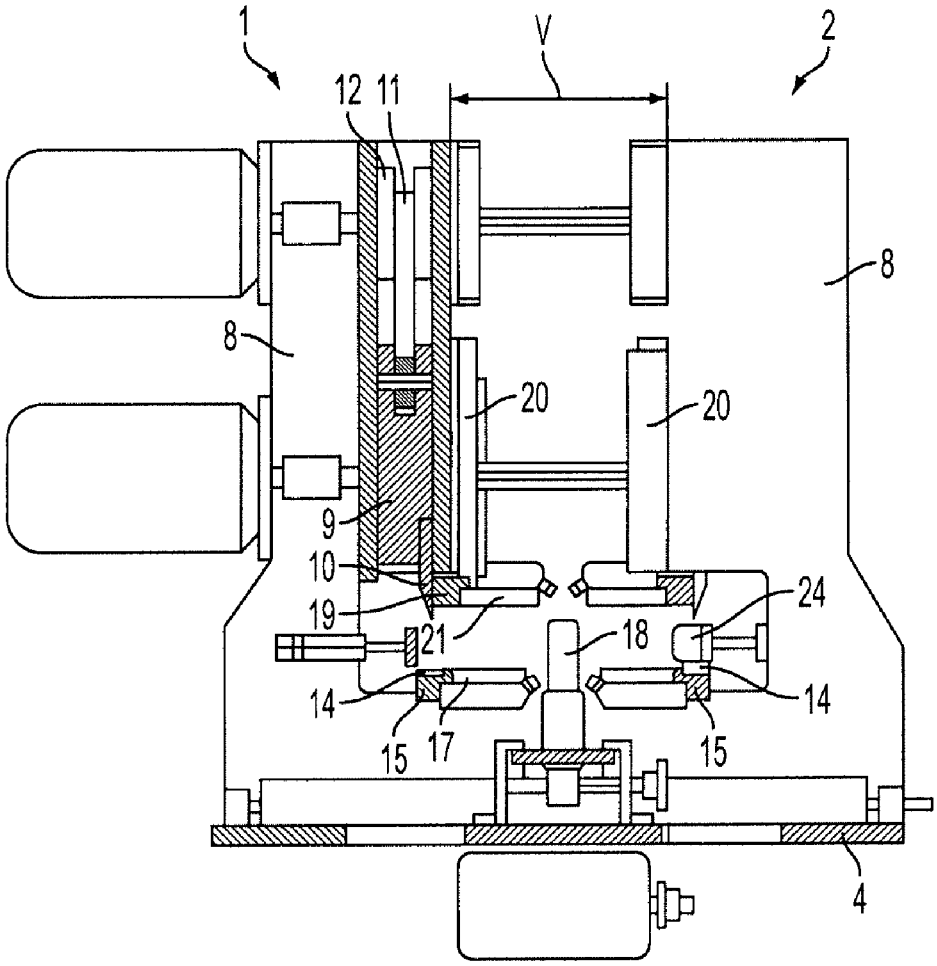
FIG. 3 is the view of the head and the foot stations in the block conveying direction.

In the head-and-foot station, the strips 15 are extended by telescoping adapters 17 to the passage area of the conveyor 18 in order to achieve a flat contact of the material to be cut, avoiding the use of format parts. FIG. 3 shows a possible shutter-like design of the adapters 17. Another possibility is the design similar to an accordion.

In the front cutting station, the pressing is performed by the plate 22, which in turn is moved by the toothed rack drive 20. Near the knife, in the pressing area proper, the plate 22 has a fixed support 22*a* and behind it an elastic support 22*b*, which is designed such that the back of the block comes into contact with it first.

The three cutting units have separate drives 3~ for moving the respective knives and pressing. The material to be cut is conveyed by the conveyors 18 and 18*a* moving to and fro as well as up and down by the strokes h1 and h2. During conveying into the head-and-foot station, the back of the block always reaches the same position regardless of the format. The pressing strips 19 have recesses in this area in order to prevent creases from being formed on the back during the trimming of brochures. In the intake, the blocks are aligned in advance by the conveyor 18 and the stop plates 23 and are aligned once again in the first cutting position by the stops 24. During the conveying by the conveyor 18*a* into the front cutting station, the block is brought over the bridge 25 up to and against the back stop 26. After the cutting has been performed, the block is then brought onto a discharge belt 27 in a manner that is not shown, e.g., by a chain conveyor running around the cutting table 16.

The trimmings drop into an exhaust channel 28. It is also possible to draw off the wastes of the two stations separately because of the glue present in the head-and-foot station.

While a specific embodiment of the invention has been shown and described in detail to illustrate the application of the principles of the invention, it will be understood that the invention may be embodied otherwise without departing from such principles.

What is claimed is:

1. A trimmer comprising:

a common support frame; and first and second cutting stations each with a cutting unit, each said cutting unit including a cutting strip and a knife for an oblique swing cut against a respective said cutting strip, said each cutting unit including a unit frame connecting said respective cutting strip to a respective said knife, said knife and said cutting strip of each respective cutting station being arranged on a respective said unit frame to perform the oblique swing cut, each of said first and second cutting stations including a table fastened to a respective said unit frame;

each of said first and second cutting stations including a pressing element movably mounted on a respective said unit frame, said table and said pressing element of each cutting station being arranged to press a block between said table and said pressing element, each said unit frame absorbing all pressing forces between respective said pressing elements and respective said tables, each said table and pressing element being movable with a respective said cutting unit on said support frame, wherein one of said cutting stations is a front cutting station and the cutting table of the front cutting station corresponds to a largest format and one of said pressing elements has a rigid front part near the knife and with a slightly obliquely positioned elastic rear part.

2. A trimmer in accordance with claim 1, where:

said pressing elements are arranged obliquely to first touch one side of a top surface of the block when said pressing element presses the block.

3. A trimmer in accordance with claim 2, wherein:

the one side of the top surface of the block is spaced from the respective said knife.

4. A trimmer in accordance with claim 1, wherein: said pressing elements each have a fixed support and an oblique support, said oblique support being more elastic than said fixed support.

5. A trimmer comprising:

a common support frame;

first and second cutting units movably mounted on said common support frame, each said cutting unit including a unit frame, a cutting strip connected to each respective said unit frame, and a knife movably mounted on said each respective unit frame for an oblique swing cut against a respective said cutting strip; and a drive unit mounted on said each unit frame of each cutting station, said drive unit generating a cutting force for moving a respective said knife against a respective said cutting strip during the oblique swing cut, each said unit frame absorbing all the cutting forces between said knife and said cutting strip during the oblique swing cut, wherein each of said first and second cutting units further includes a table fastened to a respective said unit frame and a pressing element movably mounted on a respective said unit frame, said table and said pressing element of each cutting unit being arranged to press a block between said table and said pressing element, each said unit frame absorbing all pressing forces between respective said pressing elements and respective said tables, each said table and pressing element being movable with a respective said cutting unit on said support frame, and said pressing elements each have a rigid front part near the knife and an obliquely positioned elastic rear part arranged to first touch one side of a top surface of the block when said pressing element presses the block.

6. A trimmer in accordance with claim 5, wherein:

the one side of the top surface of the block is spaced from the respective said knife.

7. A trimmer in accordance with claim 5, wherein:

said pressing elements each have a fixed support, said fixed support being arranged closer to a respective said knife than said oblique support.

8. A trimmer in accordance with claim 5, wherein:

said pressing elements each have a fixed support, said oblique support being more elastic than said fixed support.

9. A trimmer in accordance with claim 5, wherein:

said oblique support is arranged to remove air present in the block starting at the one side of the top surface when said pressing element presses the block.

10. A trimmer in accordance with claim 5, further comprising a third cutting unit movably mounted on said common support frame, said third cutting unit including a unit frame, a cutting strip and a knife arranged similar to said first and second cutting units, said first, second and third cutting units being arranged on said common support frame to trim a head, foot and front of a block.

* * * * *